United States Patent [19]

Ebi et al.

[11] 4,110,031

[45] Aug. 29, 1978

[54] ELECTROSTATIC COPYING APPARATUS

[75] Inventors: Yutaka Ebi; Masatoshi Saitou, both of Tokyo, Japan

[73] Assignee: Ricoh Company, Ltd., Tokyo, Japan

[21] Appl. No.: 727,501

[22] Filed: Sep. 28, 1976

[30] Foreign Application Priority Data

Sep. 30, 1975 [JP] Japan ..... 50-117994

[51] Int. Cl.[2] ..... G03G 15/00

[52] U.S. Cl. ..... 355/14; 355/3 CH; 355/3 TR

[58] Field of Search ..... 355/3 R, 3 CH, 3 TR, 355/3 SH, 14

[56] References Cited

U.S. PATENT DOCUMENTS

| | | | |
|---|---|---|---|
| 3,824,011 | 7/1974 | Suzuki et al. | 355/3 TR |
| 3,832,053 | 8/1974 | Goel et al. | 355/3 TR |
| 3,837,741 | 9/1974 | Spencer | 355/3 TR |
| 3,879,121 | 4/1975 | Simpson | 355/3 TR |
| 3,998,538 | 12/1976 | Urso et al. | 355/3 R |

FOREIGN PATENT DOCUMENTS

| | | | |
|---|---|---|---|
| 2,219,747 | 10/1973 | Fed. Rep. of Germany | 355/3 TR |

*Primary Examiner*—Fred L. Braun
*Attorney, Agent, or Firm*—Frank J. Jordan

[57] ABSTRACT

An electrostatic charge is applied to a dielectric peripheral surface of a transfer drum and a copy sheet is fed between the transfer drum and a photoconductive drum to transfer a toner image from the photoconductive drum to the copy sheet. The drums rotate at the same surface speed and in the same direction at adjacent portions thereof. The surface speed is maintained at a first value for a first toner transfer operation and then changed to a second value for a subsequent toner transfer operation. A voltage sensor in combination with a variable voltage source adjusts the value of the electrostatic charge on the transfer drum to a predetermined value at either surface speed.

9 Claims, 6 Drawing Figures

ELECTROSTATIC COPYING APPARATUS

BACKGROUND OF THE INVENTION

The present invention relates to an electrostatic copying machine comprising an improved toner image transfer apparatus.

It is known in the art to transfer a toner image from a photoconductive drum to a copy sheet by applying an electrostatic charge to the back of the copy sheet having a polarity which is the same as that of the electrostatic image on the drum and opposite to that of the toner particles. In this manner, the toner particles are attracted away from the drum to the copy sheet. However, this method is not suitable for a color copying system in which three or four toner image transfers are made to a single copy sheet or a multiple copy system in which a number of copies are produced by repeated developing and transfer operations utilizing a single electrostatic image.

Due to the variation of spectral sensitivity of a photoconductor in accordance with the wavelength of incident light, it is frequently necessary to perform exposure and transfer operations for the different primary colors at different surface speeds of a photoconductive drum. It has been found in practice that sufficient control cannot be provided to the transfer operations without an extremely complex apparatus to maintain the color balance within tolerable limits in an apparatus in which an electrostatic potential is applied directly to the backs of copy sheets for toner image transfer.

It has also been determined that this toner image transfer method is not applicable to a multiple copy operation since the electrostatic image is deteriorated at an excessive rate and only a few copies may be produced.

For this reason, it has been proposed to pass the copy sheets between the photoconductive drum and a transfer drum to effect toner image transfer. In this system, the transfer drum is formed with a dielectric peripheral surface and an electrostatic charge is applied to this surface. Such a system allows a much larger number of copies to be produced from a single electrostatic image.

However, it has been determined that, due to the limited photosensitivity of known photoconductors, a toner image transfer operation may be performed more quickly than an imaging operation. In a multiple copying operation, it is therefore advantageous from the viewpoint of copying speed and efficiency to produce the first copy of an original document at a slow speed required for imaging and subsequent copies from the same electrostatic image at a higher speed at which toner image transfer may still be accomplished.

A problem has remained heretofore in practical application in that the electrostatic potential applied to a transfer drum from a charging source such as a corona discharge unit varies as a function of the surface speed of the transfer drum. Specifically, the potential decreases with an increase in transfer drum surface speed since a given area on the surface of the drum spends less time adjacent to the charging unit.

The electrostatic potential on the transfer drum must, however, be maintained at an optimum value for toner image transfer regardless of the surface speed of the transfer drum. If the potential is too high, the electrostatic image on the photoconductive drum will be deteriorated. If the potential is too low, the toner image transfer will be incomplete resulting in copies of insufficient density.

SUMMARY OF THE INVENTION

It is an object of the present invention to provide an electrostatic copying machine comprising an improved toner image transfer apparatus which overcomes the above described drawbacks of the prior art.

It is another object of the present invention to increase the number of copies which can be produced in a multiple copy operation in which a number of copies are produced from a single electrostatic image.

It is another object of the present invention to provide improved control of color balance in color electrostatic copying by means of a novel but simple apparatus.

It is another object of the present invention to provide an electrostatic copying machine in which an electrostatic potential applied to a transfer drum or belt is maintained at a predetermined optimum value regardless of the speed of rotation thereof.

It is another object of the present invention to provide a generally improved electrostatic copying apparatus.

Other objects, together with the foregoing, are attained in the embodiments described in the following description and illustrated in the accompanying drawings.

DESCRIPTION OF THE PREFERRED EMBODIMENTS

While the electrostatic copying apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
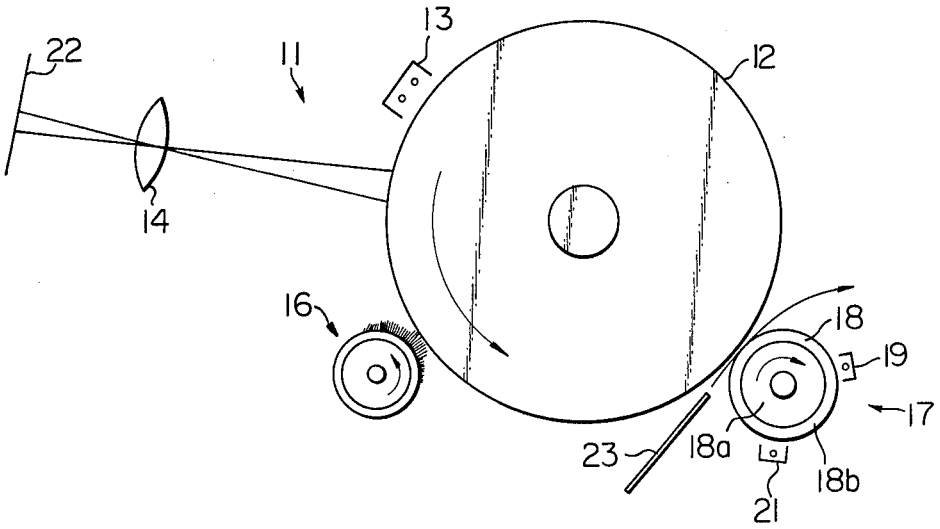
FIG. 1 is a simplified schematic view of an electrostatic copying machine to which the present invention constitutes a novel improvement.

Referring now to FIG. 1, an electrostatic copying machine which is generally designated as 11 comprises a photoconductive drum 12 which is driven for counterclockwise rotation as indicated. The drum 12 is formed with a photoconductive surface layer (not designated) as will be described below. Arranged around the circumference of the drum 12 are a corona charging unit 13, an imaging optical system which is symbolized by a lens 14, a magnetic brush developing unit 16 and a transfer unit 17.

The transfer unit 17 comprises a cylindrical transfer drum 18 which is driven for clockwise rotation and is formed of an inner conductive core **18*a* made of, for example, rubber, and an outer dielectric layer 18*b*. The layer 18*b* is typically a polyester film which is 75 microns thick. A corona discharging unit 19 and a corona charging unit 21 are arranged around the circumference of the transfer drum 18**.

In operation, the corona charging unit 13 charges the photoconductive layer on the drum 12 to a predetermined electrostatic potential. The lens 14 is arranged to radiate a light image of an original document 22 which is illuminated by a light source (not shown) onto the surface of the drum 12. The document 22 is moved in synchronism with the drum 12 in a conventional manner to form an electrostatic image of the document 22 on the drum 12 by photoconduction. The photoconductive layer on the drum 12 conducts in the bright areas of the image but does not conduct in the dark areas of the image so that the electrostatic charge applied by the charging unit 13 is dissipated only in the bright image areas.

The developing unit 16 is also shown symbolically and applies a powdered toner substance to the drum 12 to develop the electrostatic image into a toner image.

The toner particles may have a charge opposite in polarity to that of the electrostatic image, so as to adhere to the dark areas of the electrostatic image by electrostatic attraction. Alternatively, the toner particles may have no charge of their own but be attracted to the dark areas of the electrostatic image by electrostatic induction.

The developing unit 16 develops the electrostatic image as described above to produce a toner image corresponding thereto on the surface of the drum 12. The transfer drum 18 is driven for rotation so that the adjacent areas of the drums 12 and 18 move in the same direction and at the same surface speed. A copy sheet 23 is fed between the drums 12 and 18 to transfer the toner image from the photoconductive drum 12 to the copy sheet 23.

The rotation of the drums 12 and 18 is synchronized so that the leading edge of the sheet 23 reaches the transfer drum 18 in synchronism with the leading edge of the toner image on the photoconductive drum 12. The charging unit 21 applies an electrostatic charge to the dielectric layer **18*b* of the transfer drum 18 of the same polarity as the electrostatic image and of opposite polarity to the toner particles (if the toner particles are charged) so that the toner image is attracted away from the photoconductive drum 12 onto the copy sheet 23 by electrostatic force. The sheet 23 is pressed between the drums 12 and 18 by a pressure of typically 0.4kg and the toner image is subsequently fixed to the copy sheet 23 by heat, pressure or a combination thereof by a fixing unit which is not shown. The discharging unit 19 serves to partially discharge the transfer drum 18 prior to recharging by the charging unit 21** to prevent accumulation of charge to an undesirable level.

Figure 3:
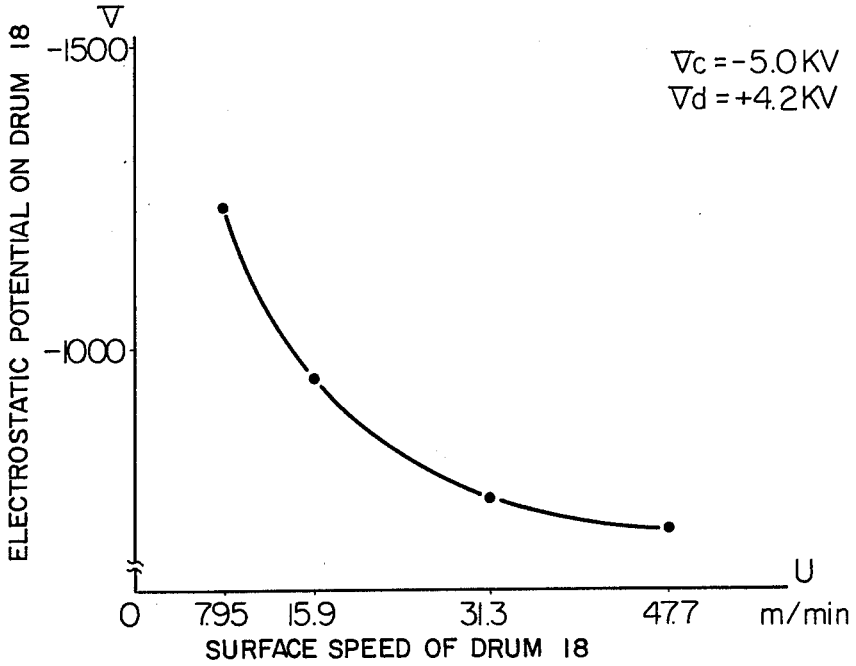
FIGS. 3 and 4 are graphs illustrating the principle of the present invention.

FIG. 3 illustrates the electrostatic potential V which is maintained on the transfer drum 18 as a function of the applied voltage V*c* of the charging unit 21, the applied voltage V*d* of the discharging unit 19 and the surface speed U of the transfer drum 18. In this plot, V*c* and V*d* are held constant at values of −5.0kv and +4.2kv respectively so that the relationship between surface speed U and the resulting electrostatic potential V may be examined.

It will be seen that the electrostatic potential V decreases in approximately inverse proportion as the surface speed U increases. In order to maintain the electrostatic potential V at a specified optimum value regardless of the surface speed U, it is therefore necessary to either increase the charging voltage V*c* or decrease the discharging voltage V*d* as the surface speed U increases. Although not illustrated, an increase in V*c* would displace the curve upwardly in a generally parallel manner and an increase in V*d* would increase the downward slope of the curve.

Figure 4:
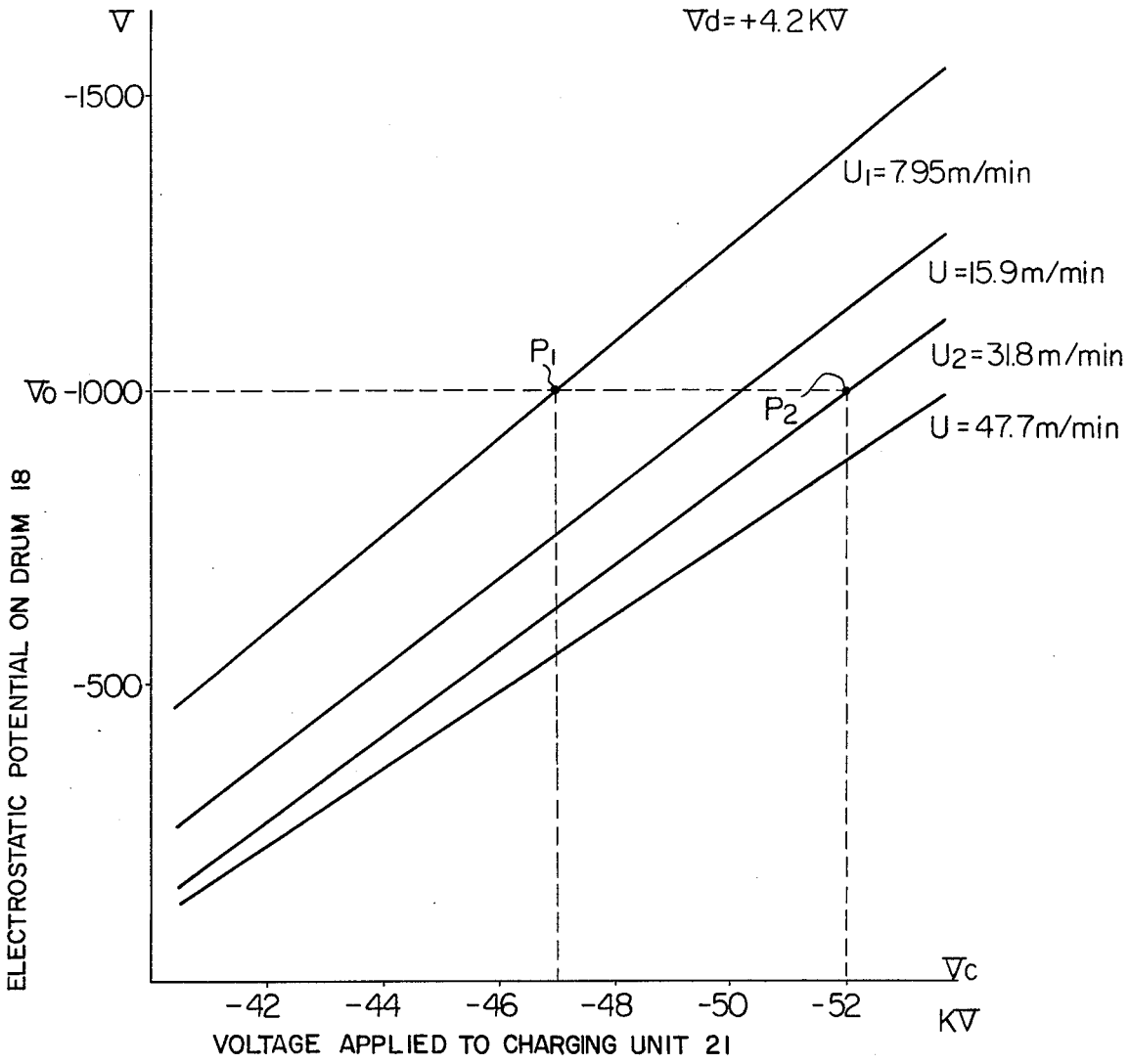

Referring now to FIG. 4, the discharge voltage V*d* is held constant at V*d*=4.2kv and the charging voltage V*c* is varied to determine the relationship between the charging voltage V*c* and the resulting electrostatic potential V on the transfer roller 18. Plots are shown for a base surface speed U of 7.95m/min and multiples of 2, 4 and 6 times the base speed, the numerical values of the multiples being 15.9, 31.8 and 47.7m/min respectively. It will be seen that at a given surface speed U the electrostatic potential V is substantially proportional to the charging voltage V*c*. An increase in surface speed U displaces the curve downwardly, although the downward displacement becomes less pronounced at higher values of surface speed U.

FIG. 4 illustrates how to predetermine the charging voltage V*c* so that the electrostatic potential V will have a corresponding predetermined value V*o* regardless of the surface speed U. Taking as an example a multiple copy system in which a number of copies are to be produced from a single electrostatic image, it will be assumed that the photoconductive drum 12 must be imaged at a low imaging speed U1 of 7.95m/min. Since the leading part of the image is being transferred while the trailing part of the image is being imaged and the central part of the image is being developed, the first copy must be produced at the imaging speed U1. However, with the imaging unit 14 de-energized, subsequent copies may be produced by repeated development and transfer of the electrostatic image produced by the initial imaging operation. Toner image transfer may be produced at a much higher transfer speed U2 of 31.8m/min, and subsequent copies may therefore be produced at the speed U2. Furthermore, effective transfer is attained at any surface speed U in the operating range of the copying machine 11 when the predetermined value V*o* of the electrostatic potential V on the transfer drum 18 is equal to −1.0kv.

As illustrated in FIG. 4, a horizontal line drawn through −1.0kv on the ordinate axis intersects the U1=7.95m/min curve at a point P1. A vertical line drawn through point P1 intersects the abscissa axis at −4.7kv. Therefore, a charging voltage of −4.7kv applied to the transfer drum 18 by the charging unit 21 will provide the required electrostatic potential V*a*=−1.0kv thereon for optimum toner image transfer.

In a similar manner, a horizontal line through −1.0kv on the ordinate axis intersects the U2=31.8m/min curve at a point P2. A vertical line drawn through point P2 intersects the abscissa axis at −5.2kv. Thus, the required electrostatic potential V*o*=−1.0kv will be provided on the transfer drum 18 at the surface speed U2=31.8m/min when the charging unit 21 applies a voltage of −5.2kv thereto.

Although the procedure is herein described as applied to a multiple copying system in which the drums 12 and 18 are rotated at only two different speeds, it will be clearly understood that the principle of the invention may be easily applied to a system in which the drums 12 and 18 are rotated at three or more different speeds. For example, in a color copying operation, the drums 12 and 18 may be sequentially rotated at four different speeds for respective imaging and transfer operations of a monochrome image and three primary color images. By providing a plot corresponding to FIG. 4, the charging voltage V*c* for each of the four speeds required to provide the predetermined electrostatic potential $V_o$ at each of the respective speeds may easily be determined.

Figure 5:
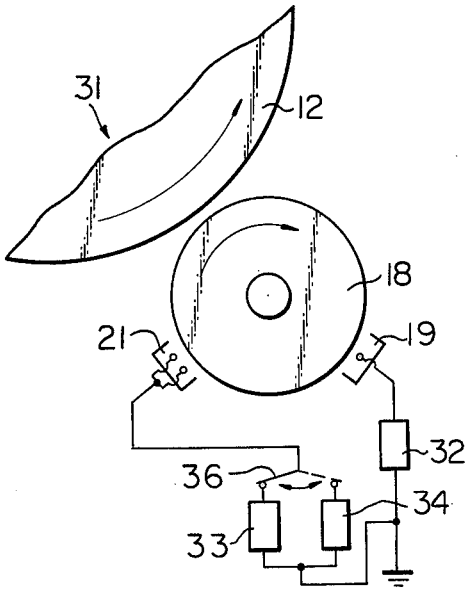
FIG. 5 is a fragmentary schematic view illustrating a second embodiment of the present invention.

The present invention may be embodied by either an open loop control system or a closed loop control system. An example of an open loop system is illustrated in FIG. 5 in which the copying machine is designated as 31. Like elements are, however, designated by the same reference numerals as in FIG. 1.

The copying machine 31 comprises a discharging voltage source 32 which applies the selected value of discharging voltage, in this example $V_d = +4.2$kv, to the discharging unit 19. The copying machine 31 further comprises two charging voltage sources 33 and 34 and a switch 36 to selectively connect one or the other of the charging voltage sources 33 and 34 to the charging unit 21. The voltage source 33 provides a voltage of −4.7kv and the voltage source 34 provides a voltage of −5.2kv.

Although not shown, the copying machine 31 comprises a control unit which controls the drums 12 and 18 to rotate at a surface speed of either U1 or U2 in accordance with the sequence of the multiple copying operation. This control unit is also connected to control the switch 36 to connect the charging unit 21 to the −4.7kv voltage source 33 or to the −5.2kv voltage source 34 when the surface speed U is U1 or U2 respectively. In this manner, the proper voltage is applied to the charging unit 21 to provide the electrostatic potential V on the transfer drum 18 at the optimum value of $V_o$.

Figure 6:
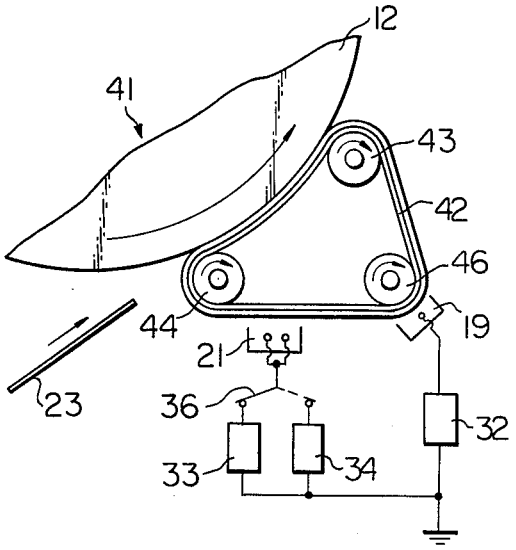
FIG. 6 is a fragmentary schematic view illustrating a third embodiment of the present invention.

FIG. 6 illustrates a copying machine 41 which is essentially similar to the copying machine 31 except that the transfer drum 18 is replaced by an endless transfer belt 42 which is trained around drive rollers 43, 44 and 46. The peripheral surface of the belt 42 is formed with a dielectric layer (not designated) in the same manner as the transfer drum 18 and the belt 42 is driven at the same surface speed as the photoconductive drum 12. The sheet 23 is fed between the drum 12 and belt 42 for toner image transfer. The belt 42 is charged by the charging unit 21 and discharged by the discharging unit 19. The operation of the copying machine 41 is essentially similar to that of the copying machine 31 and will not be described in detail.

Figure 2:
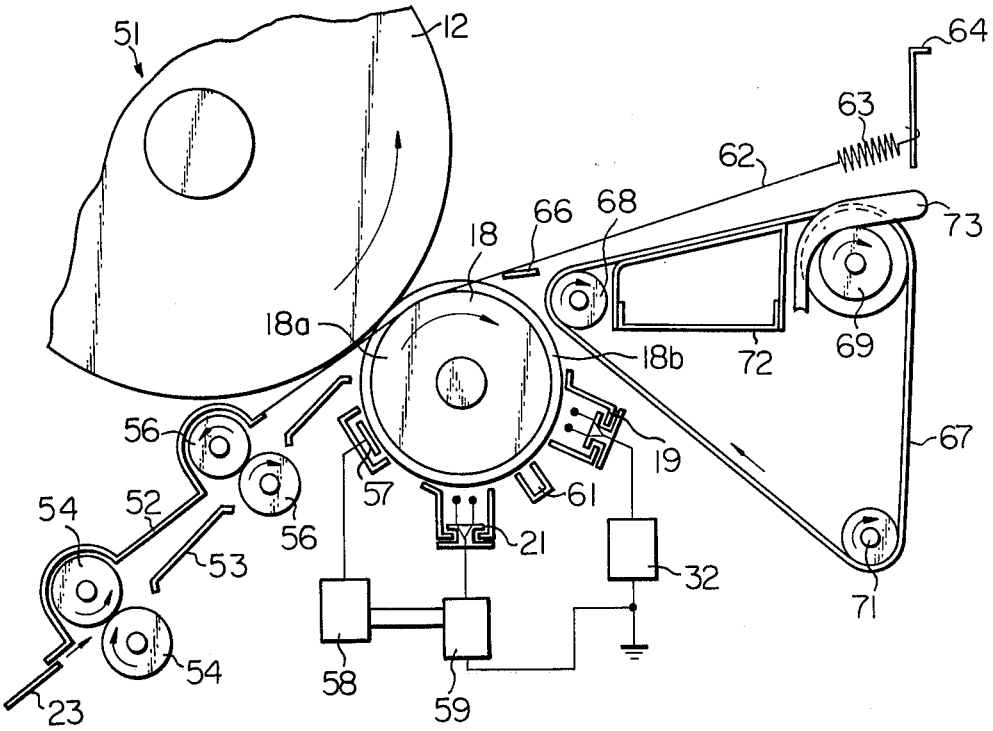
FIG. 2 is a fragmentary schematic view of a first embodiment of the present invention.

FIG. 2 illustrates a copying machine 51 which embodies a closed loop control system in accordance with the present invention. Again, like elements are designated by the same reference numerals. Upper and lower guide plates 52 and 53 are illustrated which cooperate with feed rollers 54 and 56 to feed the sheet 23 between the photoconductive drum 12 and the transfer drum 18 in proper synchronization.

The copying machine 51 further comprises a voltage sensor 57 which is disposed adjacent to the circumference of the transfer drum 18 downstream of the charging unit 21 to sense the value of electrostatic potential V on the surface of the transfer drum 18. The sensor 57 connected to a voltage comparator 58 which determines whether the sensed potential V is equal to, lower, or greater than the predetermined potential $V_o$. The output of the comparator 58 is connected to a variable voltage source 59 which supplies the operating voltage to the charging unit 21. If the sensed potential V is equal to $V_o$, the comparator 58 controls the voltage source 59 to maintain the voltage output thereof at the current value. If the sensed potential V is less than $V_o$, the comparator 58 controls the voltage source 59 to increase its output voltage so that the potential V increases until it is adjusted to, or converges to $V_o$. Conversely, if the sensed potential V is greater than $V_o$, the voltage source 59 is controlled to decrease its output voltage so that the sensed potential V will decrease and converge to $V_o$. Also illustrated in FIG. 2 is a cleaning unit 61 disposed between the discharging unit 19 and the charging unit 21 to remove adhered toner particles and dust from the transfer drum 18.

A wire 62 is connected at one end to the upper guide plate 52 and at its other end to a tension spring 63, the opposite end of which is connected to a frame member 64. The wire 62 is tensioned by the spring 63 so as to press laterally against the periphery of one end of the transfer drum 18 as shown. If required, grooves (not designated) may be formed in the peripheries of the drums 12 and 18 at the corresponding ends thereof to accomodate the wire 62. The sheet 23, after being pressed between the drums 12 and 18 for toner image transfer, is gripped at one edge between the wire 62 and the transfer drum 18 and progressively separated thereby from the photoconductive drum 12. A separator guide 66 subsequently separates the copy sheet 23 from the wire 62 and guides the sheet 23 onto a feed conveyor belt 67 which is trained around drive rollers 68, 69 and 71 which rotate the belt 67 clockwise as indicated to feed the copy sheet 23 away from the transfer drum 18 to a fixing unit (not shown). The belt 67 is formed with a large number of perforations (not visible). A vacuum unit 72 is provided inside the run of the belt 67 and applies a suction force to the sheet 23 through the perforations in the belt 67 to positively adhere the sheet 23 to the belt 67. A separator guide 73 is provided at the roller 69 to remove the copy sheet 23 from the belt 67.

In summary, it will be understood that the objects of the present invention are achieved in the embodiments shown which maintain the electrostatic potential on a transfer drum or belt at an optimum value regardless of the rotational speed thereof. A large number of copies may therefore be produced from a single electrostatic image and excellent color balance may be provided in color copying. The invention may be adapted to a semi-moist developing system, although a dry system is herein shown and described.

Furthermore, although the various embodiments of the invention disclosed herein adjust the electrostatic potential to a single optimum value regardless of the surface speed of the transfer drum, the optimum electrostatic potential may vary significantly as a function of surface speed. The embodiments of FIGS. 5 and 6 may be very simply adapted to provide different electrostatic potentials at the different respective surface speeds through suitable selection of the voltages produced by the voltage sources 33 and 34. The embodiment of FIG. 2 may produce the same result by providing different comparison values for the comparator 58 at the different surface speeds and a switch controlled in the manner of the switch 21 of FIGS. 5 and 6 to select the required comparison value.

Many other modifications within the scope of the present invention will become possible for those skilled in the art after receiving the teachings of the present disclosure.

What is claimed is:

1. An electrostatic copying apparatus comprising:

a rotary photoconductive member rotatable in a predetermined direction;

a rotary transfer member formed with a dielectric peripheral surface and being rotatable in close proximity to a surface of the photoconductive member in a direction opposite to the predetermined direction so that the adjacent surfaces thereof move in the same direction and at the same surface speed which is selectively changeable between a first predetermined value and a second predetermined value;

charging means for applying an electrostatic potential to the dielectric surface of the transfer member;

sensing means for determining the value of the electrostatic potential on the transfer member; and control means responsive to the sensing means for controlling the charging means to adjust the value of the electrostatic potential to first and second predetermined values corresponding to the first and second predetermined values of surface speed respectively.

2. An apparatus as in claim 1, further comprising discharging means for discharging the transfer member prior to charging by the charging means.

3. An apparatus as in claim 1, in which the transfer member is in the form of a cylinder.

4. An apparatus as in claim 1, in which the transfer member is in the form of an endless belt.

5. An apparatus as in claim 1, in which the sensing means comprises a voltage sensor and the charging means comprises a variable voltage source controlled by the voltage sensor.

6. An apparatus as in claim 1, in which the charging means comprises voltage source means switchable to selectively apply first and second voltages corresponding to the first and second predetermined values of surface speed to the transfer member, the first and second predetermined voltages being so predetermined that the electrostatic potential on the transfer member will assume the first and second predetermined values thereof at the first and second predetermined values of surface speed respectively; the control means comprising switch means connected to switch the voltage source means.

7. An apparatus as in claim 1, further comprising sheet feed means for feeding a copy sheet between the photoconductive member and the transfer member for toner image transfer.

8. An apparatus as in claim 7, further comprising separator means for separating the copy sheet from the photoconductive member and the transfer member after toner image transfer.

9. An apparatus as in claim 1, in which the first and second predetermined values of electrostatic potential are equal.

* * * * *